US005630707A

United States Patent [19]

Kim et al.

[11] Patent Number: 5,630,707

[45] Date of Patent: May 20, 1997

[54] VARIABLE DISPLACEMENT MECHANISM FOR SWASH PLATE TYPE HYDRAULIC PUMP AND MOTOR

[75] Inventors: Hyong-Eui Kim; Young-Bog Ham, both of Changwon-Si, Rep. of Korea

[73] Assignee: Korea Institute of Machinery & Metals, Daejeon-Si, Rep. of Korea

[21] Appl. No.: 412,125

[22] Filed: Mar. 28, 1995

[30] Foreign Application Priority Data

Oct. 1, 1994 [KR] Rep. of Korea ..... 94-25219

[51] Int. Cl.[6] ..... F04B 1/32

[52] U.S. Cl. ..... 417/269; 91/506; 92/12.2

[58] Field of Search ..... 417/222.1, 269; 92/12.1, 12.2, 57; 91/505, 506

[56] References Cited

U.S. PATENT DOCUMENTS

| | | | |
|---|---|---|---|
| 3,130,817 | 4/1964 | Wahlmark | 417/222.1 |
| 3,233,555 | 2/1966 | Wahlmark . | |
| 3,256,782 | 6/1966 | Ebert | 91/505 |
| 3,830,593 | 8/1974 | Chanal | 91/506 |
| 4,690,036 | 9/1987 | Kosaka et al. | 92/12.2 |
| 4,793,240 | 12/1988 | Nagahara et al. | 91/506 |
| 5,184,536 | 2/1993 | Arai | 91/506 |

FOREIGN PATENT DOCUMENTS

| | | | |
|---|---|---|---|
| 1296128 | 5/1962 | France | 91/506 |
| 1246486 | 9/1971 | United Kingdom | 91/506 |

*Primary Examiner*—Timothy Thorpe
*Assistant Examiner*—William Wicker
*Attorney, Agent, or Firm*—Nikaido, Marmelstein, Murray & Oram LLP

[57] ABSTRACT

A variable displacement mechanism for a swash plate hydraulic pump or motor, in which a swash plate, a swash plate guiding wall, a tilting control piston, and a swash plate tilting guiding and swash plate rotation preventing pin are included for varying the requiring flow rate (volumetric displacement) per revolution without the rotation of the swash plate even during the tilting of the swash plate angle and during the rotation of the hydraulic pump or motor. The periphery of the swash plate is spherical for smoothing the tilting of the swash plate, and a securing pin accommodating slot is formed on the lower portion of the swash plate. Further, there are provided a securing pin for preventing rotation of the swash plate, and a bore formed on the bottom of a front cover for installing the securing pin. A housing or the front cover is provided with a guide wall for guiding the tilting of the swash plate, so that the volumetric displacement can be varied even during the rotation of the hydraulic pump or motor, thereby varying the discharge rate of the hydraulic pump or varying the rotating speed of the hydraulic motor in a safe manner.

4 Claims, 4 Drawing Sheets

FIG.4A
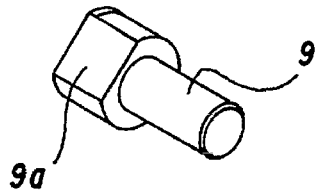
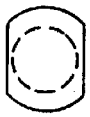
FIG.4B
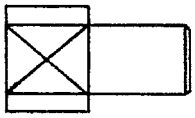
FIG.4C
FIG.5
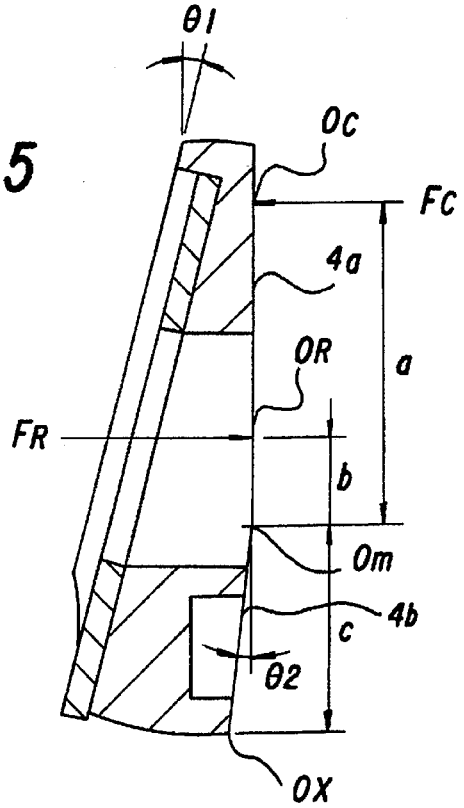

VARIABLE DISPLACEMENT MECHANISM FOR SWASH PLATE TYPE HYDRAULIC PUMP AND MOTOR

The present invention relates to a method for tilting the swash plate and preventing the rotation of it for varying the volumetric displacement of a swash plate hydraulic pump or motor. Particularly, the present invention relates to a variable displacement swash plate hydraulic pump or motor, in which a swash plate, a swash plate guiding wall, a tilting control piston, and a swash plate tilting guiding and swash plate rotation preventing pin are included for varying the requiring flow rate (volumetric displacement) per revolution without the rotation of the swash plate even during the tilting of the swash plate angle during the rotation of the hydraulic pump or motor.

BACKGROUND OF THE INVENTION

In the conventional axial piston hydraulic pump and motor, by varying the angle of the swash plate, the capacity is varied to obtain various flow rates at the same speed in the case of a hydraulic pump, or to obtain various speeds with the same flow rate in the case of a hydraulic motor. However, in the hydraulic pump and motor, only tilting motions have to be carried out within a certain angular range in accordance with the rotations of a cylinder block and a piston block without rotation of the swash plate. Therefore, in order to prevent rotation of the swash plate, the swash plate has a trunnion in which a tilting shaft is connected to the center of the swash plate, or the swash plate and the both sides of the bottom are provided in a half cylindrical shaped form, thereby providing a cradle type. Such forms have a problem of complicated structure, and therefore, the machining task is difficult, while they are problematic in view of the compactness.

SUMMARY OF THE INVENTION

The present invention is intended to overcome the above described disadvantages of the conventional techniques.

Therefore, it is the object of the present invention to provide a swash plate hydraulic motor and a variable displacement mechanism for the motor, in which the tilting of the swash plate is guided by a swash plate guide wall and a swash plate rotation preventing pin, so that the angle of the swash plate can be varied without the rotation of the swash plate even during the rotation of the hydraulic pump and the hydraulic motor and during the tilting of the swash plate.

BRIEF DESCRIPTION OF THE DRAWINGS

The above object and other advantages of the present invention will become more apparent by describing in detail the preferred embodiment of the present invention with reference to the attached drawings in which:

FIG. 4A is a perspective view of the shape of a security pin;

FIG. 4B is a left side view thereof;

FIG. 4C is a frontal view thereof; and

FIG. 5 illustrates the forces which act on the swash plate.

DESCRIPTION OF THE PREFERRED EMBODIMENT

Figure 1:
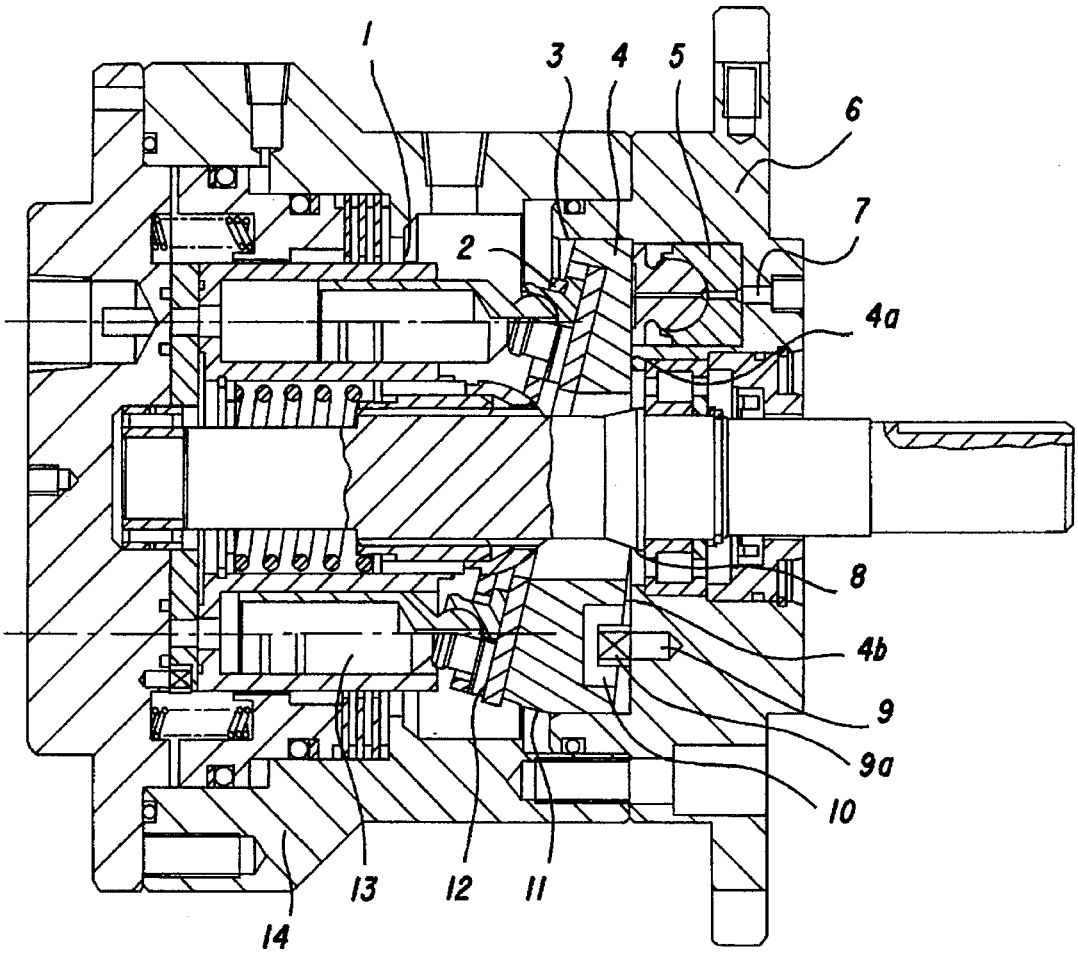
FIG. 1 is a sectional view showing the constitution of the device of the present invention.
Figure 2A:
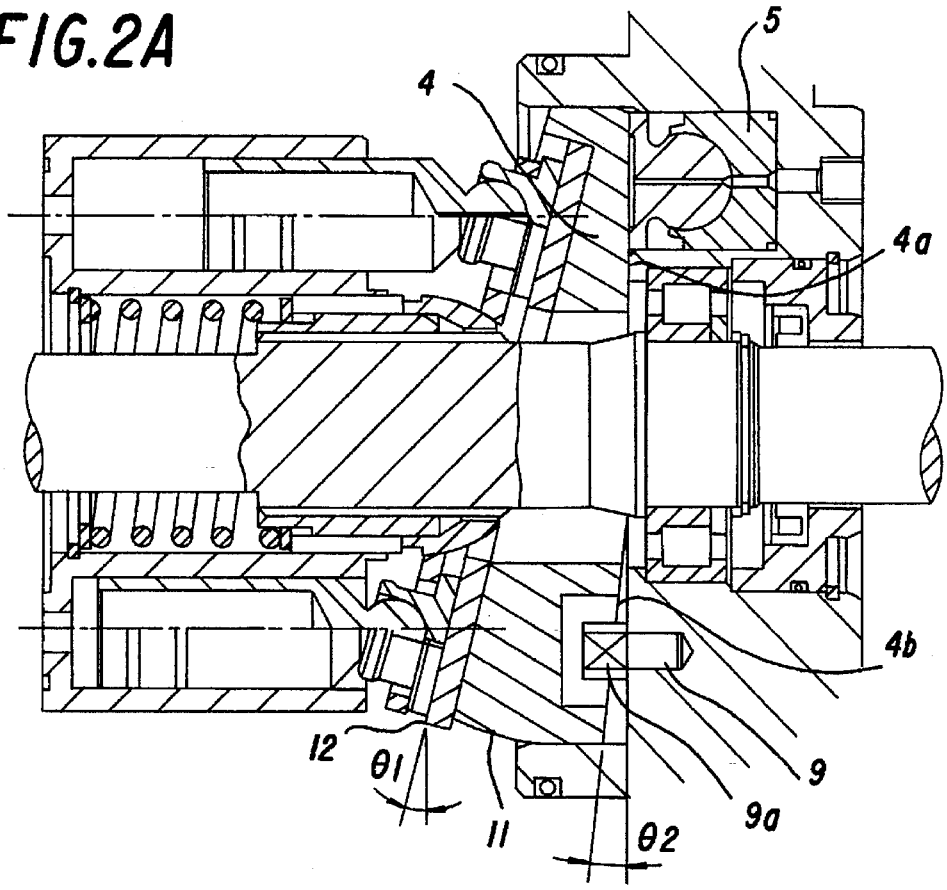
FIG. 2A illustrates a tilting of the swash plate to the maximum angle.
Figure 2B:
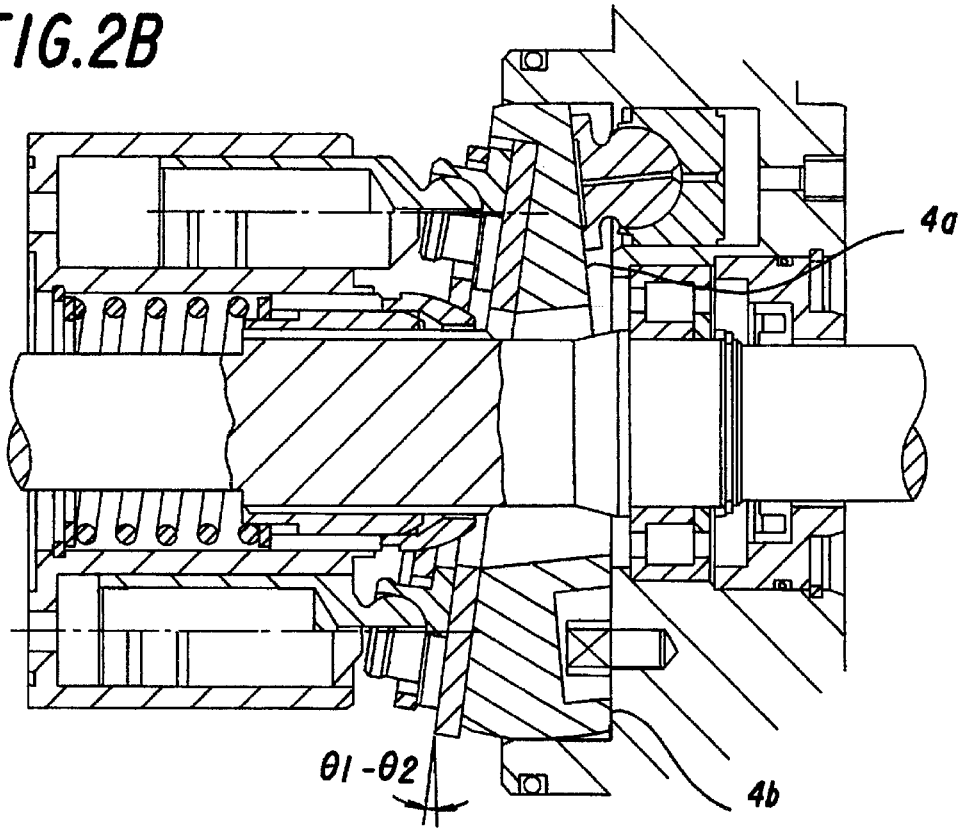
FIG. 2B illustrates a tilting to the minimum angle.

FIG. 1 is a sectional view showing a hydraulic motor in which the swash plate and swash plate tilting guide mechanism of the present invention are added to the conventional swash plate hydraulic motor. The overall constitution of the hydraulic motor of the present invention will be described referring to FIG. 1.

A front cover 6 is provided with holes for nine pistons 13 which perform rotating movements and sliding movements along an inclined face 12 of a swash plate 4, and at the same time, performs reciprocating movements within a cylinder barrel 1. The front cover 6 further includes a pin bore for a securing pin 9 which prevents the rotation of the swash plate together with a piston/slipper pad assembly 2 due to the friction torque. Further, the front cover 6 is provided with a swash plate guide wall 3 which guides the tilting of the swash plate, and which prevents rotation of the swash plate in cooperation with the securing pin 9. This swish plate guide wall 3 has a simple circular form.

The front cover 6 is provided with a cylindrical bore for a swash plate tilting control piston 5 for tilting the swash plate 4. In the case where the tilting control piston 5 uses an oil ring, the precision of the inside diameter of the cylindrical bore is not sternly limited. However, in the case where a mechanical sealing is applied to between the outside diameter of the piston 5 and the inner wall of the cylindrical bore, the precision of the inside diameter of the cylindrical bore is sternly limited by taking into account the outside diameter of the piston 5 so as to prevent the loss of the tilting control pressure and the leaking of the oil, when the control piston is assembled. The front cover 6 further includes a hydraulic fluid supplying conduit 7 for supplying the control pressure into the cylindrical bore.

As shown in FIG. 4, the securing pin 9 is constituted as follows. That is, the portion which is buried into the pin bore in the front cover 6 is round cylindrically shaped, while the portion which is buried into a securing pin accommodating slot 10 of the swash plate 4 is formed into two flat faces **9*a*. Thus, the exact position of the swash plate 4 on the front cover 6 is determined, and the swash plate 4 forms a face contact with the securing pin accommodating slot 10**, so that the tilting of the swash plate would be guided while preventing rotation of the swash plate.

Figure 3A:
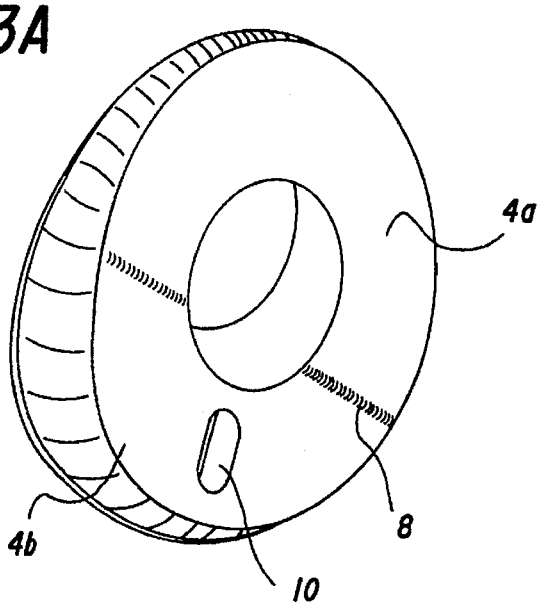
FIG. 3A is a perspective view of the shape of the swash plate.
Figure 3B:
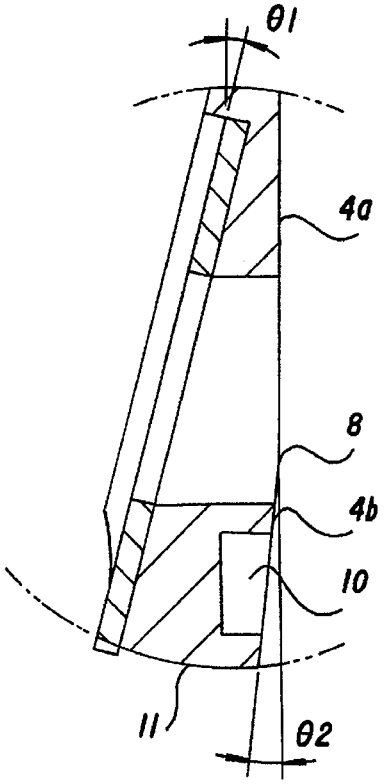
FIG. 3B is a sectional view thereof.
Figure 3C:
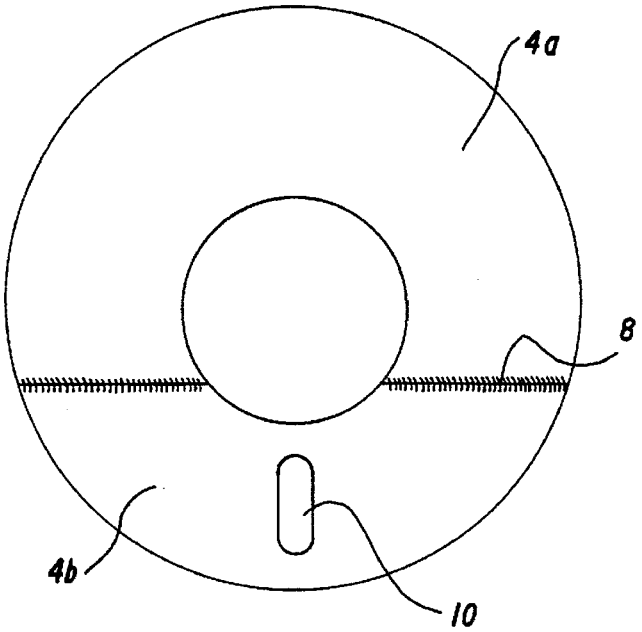
FIG. 3C is a frontal view thereof.

The swash plate 4 according to the present invention has a cross cylindrical rocking boundary edge 8, so that the swash plate 4 can be contacted smoothly with the bottom of the front cover 6 when rocking between a first tilting face **4*a* and a second tilting face 4*b*, the first tilting face 4*a* forming a large angle θ 1, and the second tilting face 4*b* forming a small angle θ2, as shown in FIG. 3B. In order to prevent an impediment in tilting the swash plate 4, the side portion of the swash plate 4 has a spherical form 11, so that it can slide along a housing 14 or the guide wall 3 of the front cover 6. Further, the swash plate 4 includes the slot 10 for accommodating the securing pin 9 for the purpose of guiding the tilting of the swash plate 4, and for the purpose of preventing rotation of the swash plate 4**.

In tilting the swash plate 4, the important factor lies in the diameter of the swash plate control piston 5 and the installation position of the piston 5. Therefore, this will be described in detail below referring to FIG. 5.

The diameter of the control piston is directly connected to a force $F_c$ of the piston which acts on the tilting of the swash plate 4. A swash plate tilting torque $T_c$ is equivalent to the piston force $F_c$ acting to the tilting of the swash plate 4 multiplied by a distance a between a center $O_c$ of the swash plate tilting control piston 5 and a tilting center $O_m$ at the boundary edge 8. The swash plate tilting torque $T_c$ confronts with a torque $T_R$ which resists the tilting of the swash plate 4, i.e., confronts with a sum total force $F_R$ of the nine pistons 13 (in the case wherein nine pistons are provided in the hydraulic motor) for rotating the cylinder barrel 1, multiplied by a distance b between a main axial center $O_R$ of the hydraulic pump or motor and a swash plate tilting center $O_m$. Under this condition, if the swash plate tilting torque $T_c$ is larger than the swash plate tilting resistance torque $T_R$, then an end $O_X$ of the circular swash plate 4 becomes an excessive tilting center, with the result that the swash plate is flipped. Therefore, based on the excessive tilting center $O_X$, the swash plate excessive tilting torque $T_{CX}$ is equivalent to the force $F_c$ acting on the tilting of the swash plate multiplied by a distance a+c between the excessive tilting center $O_X$ and the center $O_c$ of the swash plate control piston 5. A swash plate excessive tilting resistance torque $T_{RX}$ is equivalent to the sum total force $F_R$ of the nine pistons multiplied by a distance b+c between the excessive tilting center $O_X$ and a main axial center $O_R$. That is, if the swash plate 4 is to be stably tilted without being flipped, the swash plate tilting torque $T_c$ has to be larger than the swash plate tilting resistance torque $T_R$, but the excessive tilting torque $T_{CX}$ has to be smaller than the excessive tilting resistance torque $T_{RX}$.

Therefore, when $F_R$, b and a are determined based on a condition $(F_R \times b) < (F_c \times a)$, $F_c$ can be determined, and the diameter of the swash plate control piston 5 can be determined by taking into account the supply pressure. Further, $F_c$ and a are determined, and therefore, c can be determined based on a condition $[F_c \times (a+c)] < [F_R \times (b+c)]$.

According to the present invention as described above, the swash plate, the swash plate tilting control piston and the swash plate tilting guide mechanism are integrally provided within the conventional hydraulic pump or motor. Therefore, a compact and variable capacity hydraulic motor can be expected. Further, the volumetric displacement can be varied even during the rotating of the hydraulic pump or motor, so that the discharge rate of the hydraulic pump can be varied at the same speed, or that the rotating speed of the hydraulic motor can be varied with the same fluid flow rate. Thus, the functions of the hydraulic pump or motor can be diversified.

What is claimed is:

1. A variable displacement mechanism for swash plate type hydraulic pump and motor, comprising:

a housing;

a swash plate rockingly positioned in said housing;

a front cover on said housing having a bore on a face surface thereof for installing a securing pin to prevent rotation of said swash plate; said front cover further having a cylindrical bore for receiving a swash plate tilting control piston for tilting said swash plate; and said front cover further having a circular guide wall for guiding tilting of said swash plate.

2. The variable displacement mechanism as claimed in claim 1, wherein: said swash plate includes a rocking boundary edge between a first tilting face and a second tilting face; a cylindrical periphery of said swash plate has a spherical form; and said swash plate includes a securing pin accommodating slot in said second tilting face to accommodate the securing pin.

3. The variable displacement mechanism as claimed in claim 2, wherein a portion of said securing pin mounted in said bore is cylindrical, and a portion of said pin positioned in said securing pin accommodating slot of said second tilting face of said swash plate has flat faces.

4. The variable displacement mechanism as claimed in claim 1, wherein a diameter of said piston and a position of said piston are determined based on formulas $(F_R \times b) < (F_c \times a)$ and $(F_c \times (a+c) < F_R \times (b+c))$, said swash plate being stably tilted between two positions wherein:

$F_R$: sum total force of driving pistons;

$F_c$: piston force acting to the tilting of the swash plate;

$O_M$: swash plate tilting center;

$O_R$: main axial center;

$O_X$: excessive tilting center;

a: distance between $O_M$ and $O_C$;

b: distance between $O_M$ and $O_R$; and c: distance between $O_M$ and $O_X$.

* * * * *